US009157438B2

(12) United States Patent
Seong et al.

(10) Patent No.: US 9,157,438 B2
(45) Date of Patent: Oct. 13, 2015

(54) SCROLL COMPRESSOR WITH BYPASS HOLE

(75) Inventors: Sanghun Seong, Seoul (KR); Byeongchul Lee, Seoul (KR); Hakyoung Kim, Seoul (KR); Namkyu Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 180 days.

(21) Appl. No.: 13/598,673

(22) Filed: Aug. 30, 2012

(65) Prior Publication Data

US 2013/0089449 A1 Apr. 11, 2013

(30) Foreign Application Priority Data

Oct. 11, 2011 (KR) ..... 10-2011-0103812

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 15/06*** | (2006.01) |
| ***F04C 15/00*** | (2006.01) |
| ***F04C 28/06*** | (2006.01) |
| ***F04C 28/26*** | (2006.01) |
| ***F04C 23/00*** | (2006.01) |
| ***F04C 28/10*** | (2006.01) |
| *F04C 29/06* | (2006.01) |

(52) U.S. Cl.

CPC ..... *F04C 18/0215* (2013.01); *F04C 15/0049* (2013.01); *F04C 15/06* (2013.01); *F04C 18/0246* (2013.01); *F04C 18/0261* (2013.01); *F04C 23/001* (2013.01); *F04C 28/06* (2013.01); *F04C 28/10* (2013.01); *F04C 28/26* (2013.01); *F04C 29/06* (2013.01)

(58) Field of Classification Search

USPC ..... 418/15, 55.1–55.6, 57, 180; 417/310

See application file for complete search history.

(56) References Cited

U.S. PATENT DOCUMENTS

| | | | | |
|---|---|---|---|---|
| 4,303,379 | A | 12/1981 | Hiraga et al. | 418/55.2 |
| 4,655,696 | A | 4/1987 | Utter | 418/55.3 |

(Continued)

FOREIGN PATENT DOCUMENTS

| | | |
|---|---|---|
| CN | 1138669 | 12/1996 |
| CN | 1197165 | 10/1998 |

(Continued)

OTHER PUBLICATIONS

Korean Office Action dated May 20, 2013.

(Continued)

*Primary Examiner* — Theresa Trieu

(74) *Attorney, Agent, or Firm* — KED & Associates, LLP

(57) ABSTRACT

A scroll compressor is provided. The scroll compressor may include a fixed scroll having a fixed wrap with a thickness that varies along a compression path and a disk having a discharge and at least one bypass hole formed therein, and an orbiting scroll having an orbiting wrap with a thickness that varies along the compression path and that orbits with respect to the fixed scroll to define a compression space between the respective wraps. The compressor may also include a rotation shaft coupled to the orbiting scroll, and a driver that rotates the rotation shaft. A diameter of each bypass hole may be greater than one third of an effective diameter of the discharge hole.

20 Claims, 16 Drawing Sheets

(56) References Cited

U.S. PATENT DOCUMENTS

| | | | | |
|---|---|---|---|---|
| 4,774,816 | A * | 10/1988 | Uchikawa et al. | 418/55.1 |
| 5,017,108 | A | 5/1991 | Murayama et al. | 418/55.6 |
| 5,775,893 | A | 7/1998 | Takao et al. | 418/55.2 |
| 5,800,141 | A * | 9/1998 | Ceylan et al. | 418/55.1 |
| 6,030,192 | A | 2/2000 | Hill et al. | 418/55.2 |
| 6,053,714 | A | 4/2000 | Fenocchi et al. | 418/55.1 |
| 6,301,912 | B1 | 10/2001 | Terai et al. | 62/228.4 |
| 6,379,131 | B1 | 4/2002 | Hoashi | 417/440 |
| 6,464,470 | B1 | 10/2002 | Zamudio et al. | 417/297 |
| 6,579,080 | B1 | 6/2003 | Spinnler | 418/55.2 |
| 6,932,586 | B2 | 8/2005 | Furusho et al. | 418/55.5 |
| 7,371,059 | B2 | 5/2008 | Ignatiev et al. | 418/151 |
| 7,909,592 | B2 | 3/2011 | Yano et al. | 418/55.1 |
| 8,308,460 | B2 * | 11/2012 | Seong et al. | 418/55.2 |
| 2001/0014293 | A1 | 8/2001 | Tsumagari et al. | 418/55.4 |
| 2002/0039540 | A1 | 4/2002 | Kuroki et al. | 418/55.5 |
| 2006/0159567 | A1 | 7/2006 | Tazoe et al. | 417/410.3 |
| 2012/0134864 | A1 | 5/2012 | Lee et al. | 418/66 |
| 2012/0230855 | A1 | 9/2012 | Seong et al. | 418/55.2 |

FOREIGN PATENT DOCUMENTS

| | | | |
|---|---|---|---|
| CN | 1840910 | | 4/2006 |
| CN | 101144474 | | 3/2008 |
| CN | 101517237 | | 8/2009 |
| CN | 103016342 | | 4/2013 |
| CN | 103075342 | | 5/2013 |
| DE | 100 09 673 | A1 | 9/2000 |
| EP | 0 348 936 | A2 | 1/1990 |
| EP | 0 844 398 | | 5/1998 |
| EP | 1 507 085 | A1 | 2/2005 |
| GB | 2 167 132 | A | 5/1986 |
| JP | 2-019678 | | 1/1990 |
| JP | 7-269478 | | 10/1995 |
| JP | 09-032750 | | 2/1997 |
| JP | 10-246188 | | 9/1998 |
| JP | 2000-18179 | | 1/2000 |
| JP | 2001-182677 | | 7/2001 |
| JP | 2002-89463 | | 3/2002 |
| JP | 2004-060502 | | 2/2004 |
| JP | 2007-100713 | | 4/2007 |
| KR | 10-0311888 | | 9/2001 |
| KR | 10-0395163 | | 8/2003 |
| KR | 10-2009-0077294 | | 7/2009 |
| KR | 10-1059880 | | 8/2011 |
| WO | WO 96/20345 | | 7/1996 |
| WO | WO 96/20345 | A1 | 7/1996 |
| WO | WO 2007/114531 | A1 | 10/2007 |

OTHER PUBLICATIONS

Korean Office Action dated Jun. 1, 2013.
United States Office Action dated Nov. 25, 2013 issued in U.S. Appl. No. 13/454,152.
United States Office Action dated Dec. 4, 2013 issued in U.S. Appl. No. 13/454,137.
European Search Report dated Jan. 28, 2014, issued in Application No. 12 18 5162.
European Search Report dated Jan. 29, 2014, issued in Application No. 12 18 5161.
Korean Office Action issued in KR Application No. 10-2011-0103812 dated Jan. 14, 2013.
Korean Office Action issued in KR Application No. 10-2011-0104308 dated Jan. 15, 2013.
Korean Notice of Allowance issued in KR Application No. 10-2011-0101495dated Dec. 10, 2012.
Final U.S. Office Action dated Oct. 1, 2014, issued in U.S. Appl. No. 13/454,152.
Final Office Action dated May 20, 2014, issued in U.S. Appl. No. 13/454,137.
Office Action dated Jun. 30, 2014, issued in U.S. Appl. No. 13/649,310.
Chinese Office Action dated Nov. 2, 2014. (English Translation).
Chinese Office Action dated Nov. 18, 2014. (English Translation).
Chinese Office Action dated Nov. 4, 2014. (English Translation).

* cited by examiner (d)

SCROLL COMPRESSOR WITH BYPASS HOLE

BACKGROUND

1. Field

The present disclosure relates to a scroll compressor with a bypass hole, and more particularly, a scroll compressor with a bypass hole capable of preventing an excessive pressure increase within a compression chamber.

2. Background

A scroll compressor is a compressor which includes a fixed scroll having a fixed wrap, and an orbiting scroll having an orbiting wrap engaged with the fixed wrap. In this configuration of the scroll compressor, as the orbiting scroll orbits on the fixed scroll, the volumes of compression chambers, which are formed between the fixed wrap and the orbiting wrap, consecutively change, thereby sucking and compressing a refrigerant.

BRIEF DESCRIPTION OF THE DRAWINGS

The embodiments will be described in detail with reference to the following drawings in which like reference numerals refer to like elements wherein.

DETAILED DESCRIPTION

A scroll compressor may allow suction, compression and discharge to be consecutively performed, and thus may generate a relatively lower level of vibration and noise during operation than other types of compressors. In detail, the compression chamber of the scroll compressor is reduced in volume as it continuously moves toward a center, and thus refrigerant gas may be continuously sucked, compressed and discharged.

A discharge hole through which the compressed refrigerant gas is discharged may be formed adjacent to a central portion of the orbiting scroll or the fixed scroll, as the central portion has the maximum pressure. A backflow preventing valve may be provided at the discharge hole so as to prevent the refrigerant gas from flowing backward due to a pressure difference. However, in a scroll compressor having such a construction, a main frame disposed under the orbiting scroll to securely support the orbiting scroll during orbiting motion may increase the overall height of the scroll compressor.

A bypass hole for partially bypassing the compressed gas in advance and a bypass valve for opening or closing the bypass hole may also be provided, separate from the discharge hole. The bypass hole may reduce energy consumption and damage to the compressor due to over-compression by bypassing the refrigerant gas when it is over-compressed. In detail, when an operating compression ratio is lower than a design compression ratio, if a discharging start angle is not yet achieved, even if gas pressure within the compression chamber becomes the same as discharge pressure, the compression is continuously carried out, thereby causing an over-compression loss. As such, when over-compression is generated, the bypass valve is automatically open or closed according to a pressure difference between the compression chamber and the discharge hole so as to partially discharge the compressed gas in advance, thereby reducing a starting torque of the orbiting scroll or preventing damage of the wrap due to the over-compression.

In order to obtain sufficient effect in view of the reduction due to the over-compression loss, it is not necessary to increase a diameter of the bypass hole. However, in general, the diameter of the bypass hole does not exceed the thickness of the corresponding wrap. Therefore, the resulting structure may include a plurality of bypass holes with a smaller diameter than desired. This structure may make production/fabrication of the fixed scroll or orbiting scroll complicated and require a bypass valve to be installed for each bypass hole, thereby causing an increase in fabricating cost.

Figure 1:
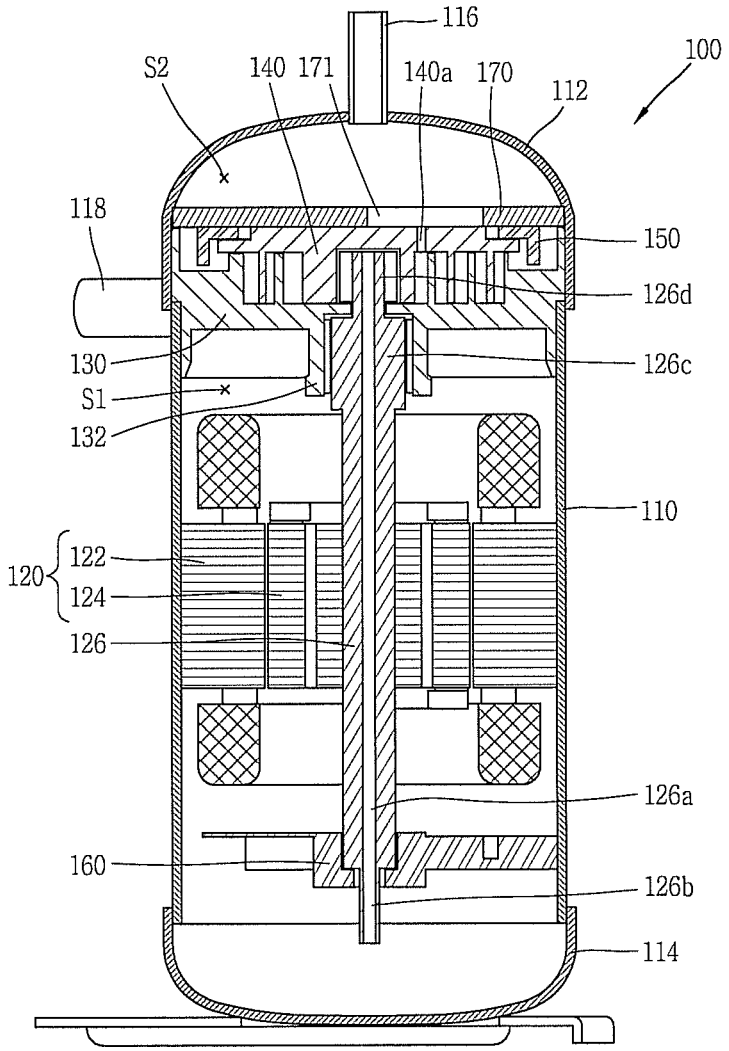
FIG. 1 is a sectional view of an inner structure of a scroll compressor in accordance with one exemplary embodiment as broadly described herein.
Figure 2:
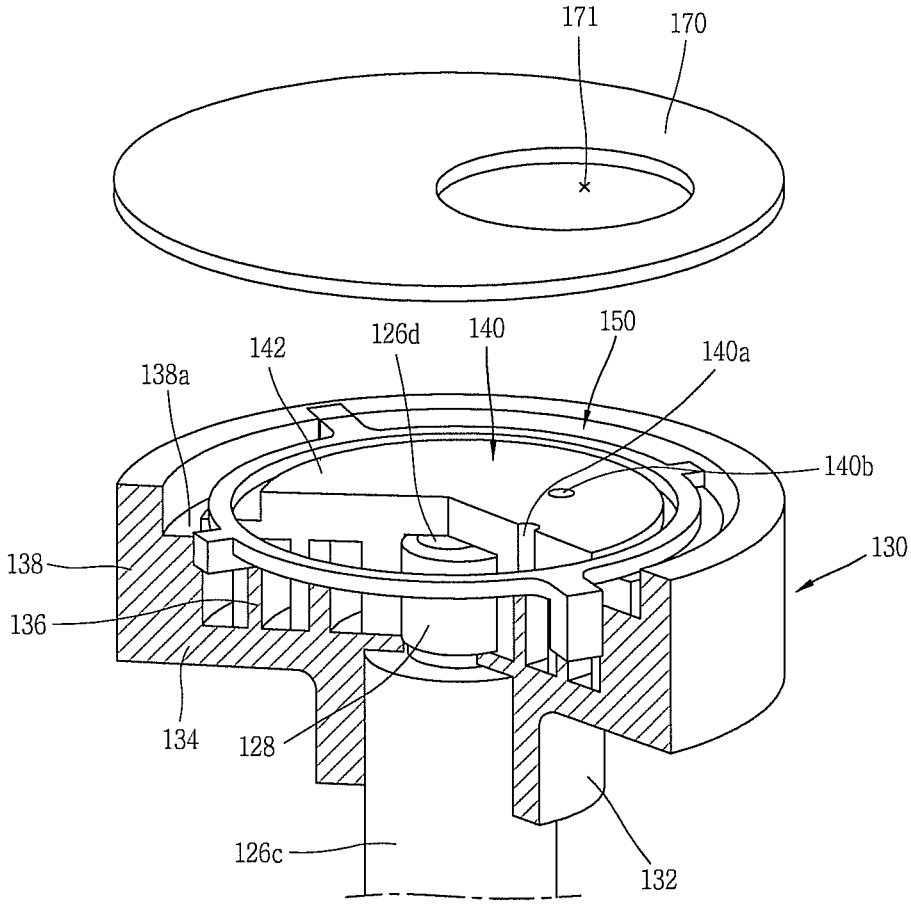
FIG. 2 is a partially cut view of a compression unit of the exemplary embodiment shown in FIG. 1.
Figure 3:
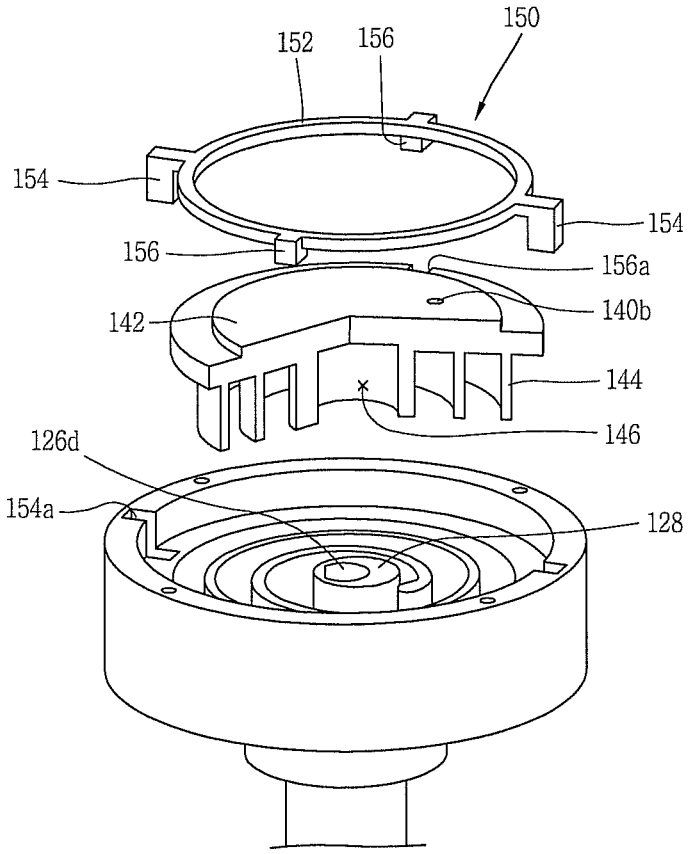
FIG. 3 is a disassembled perspective view of the compression unit shown in FIG. 2.

As shown in FIGS. 1 and 3, a scroll compressor according to one exemplary embodiment may include a casing 110 having a cylindrical shape, and an upper shell 112 and a lower shell 114 for covering upper and lower portions of the casing 110. The upper and lower shells 112 and 114 may be welded to the casing 110 so as to define a single hermetic container 100 together with the casing 110. Other attachment mechanisms may also be appropriate. A lower space of the hermetic container 100 may define a suction space S1, and an upper space thereof may define a discharging space S2. The lower and upper spaces may be divided based upon an upper frame 170 to be explained later.

A discharge pipe 116 may be connected to an upper side of the upper shell 112. The discharge pipe 116 may act as a path through which a compressed refrigerant is discharged to the outside. An oil separator (not shown) for separating oil mixed with the discharged refrigerant may be connected to the discharge pipe 116. A suction pipe 118 may be installed at a side surface of the casing 110. The suction pipe 118 may act as a path through which a refrigerant to be compressed is introduced. In the embodiment shown in FIG. 1, the suction pipe 118 is located at an interface between the casing 110 and the upper shell 116, but other positions of the suction pipe 118 may also be appropriate. In addition, the lower shell 114 may function as an oil chamber for storing oil, which is supplied to make the compressor work smoothly.

A motor 120 may be installed at an approximately central portion within the casing 110. The motor 120 may include a stator 122 fixed to an inner surface of the casing 110, and a rotor 124 located within the stator 122 and rotatable by interaction with the stator 122. A rotation shaft 126 may be disposed in the center of the rotor 124 so as to be rotatable together with the rotor 124.

An oil passage 126*a* may be formed in the rotation shaft 126 along a lengthwise direction of the rotation shaft 126. An oil pump 126*b* for pumping up oil stored in the lower shell 114 may be installed at a lower end portion of the rotation shaft 126. The oil pump 126*b* may be implemented by forming a spiral recess or separately installing an impeller in the oil passage 126*a*, or may be a separately welded or otherwise attached pump.

An extended diameter part 126*c*, which is inserted in a boss formed in a fixed scroll to be explained later, may be disposed at an upper end portion of the rotation shaft 126. The extended diameter part 126*c* may have a diameter greater than other parts of the shaft 126. A pin portion 126*d* may be formed at an end of the extended diameter part 126*c*. In alternative embodiments, the extended diameter part may be omitted and the entire rotation shaft 126 may have a specific diameter. An eccentric bearing 128 may be coupled to the pin portion 126*d*. Referring to FIG. 3, the eccentric bearing 128 may eccentrically be coupled to the pin portion 126*d*. A coupled portion between the pin portion 126*d* and the eccentric bearing 128 may have a "D" shape such that the eccentric bearing 128 cannot be rotated with respect to the pin portion 126*d*.

A fixed scroll 130 may be mounted at a boundary portion between the casing 110 and the upper shell 112. The fixed scroll 130 may have an outer circumferential surface which is shrink-fitted between the casing 110 and the upper shell 112. Alternatively, the fixed scroll 130 may be welded with the casing 110 and the upper shell 112. Other installation mechanisms may also be appropriate.

A boss 132, in which the rotation shaft 126 is inserted, may be formed at a lower surface of the fixed scroll 130. A through hole through which the pin portion 126*d* of the rotation shaft 126 is inserted may be formed through an upper surface (see FIG. 1) of the boss 132. Accordingly, the pin portion 126*d* may protrude to an upper side of a disk 134 of the fixed scroll 130 through the through hole.

A fixed wrap 136 may be formed at an upper surface of the disk 134. A side wall 138 may be located at an outer circumferential portion of the disk 134. The side wall 138 may define a space for housing an orbiting scroll 140 and may contact an inner circumferential surface of the casing 110. An orbiting scroll support 138*a*, on which an outer circumferential portion of the orbiting scroll 140 is received, may be formed inside an upper end portion of the side wall 138. A height of the orbiting scroll support 138*a* may be substantially the same height as the fixed wrap 136 or a slightly higher than the fixed wrap 136, such that an end of the orbiting wrap may contact a surface of the disk 134 of the fixed scroll 130.

The orbiting scroll 140 may be disposed on the fixed scroll 130. The orbiting scroll 140 may include a disk 142 having an approximately circular shape and an orbiting wrap 144 engaged with the fixed wrap 136. A rotation shaft coupling portion 146 having an approximately circular shape may be formed at a central portion of the disk 142 such that the eccentric bearing 128 may be rotatably inserted therein. An outer circumferential portion of the rotation shaft coupling portion 146 may be connected to the orbiting wrap 144 so as to define compression chambers together with the fixed wrap 136 during compression.

The eccentric bearing 128 may be inserted into the rotation shaft coupling portion 146, the end portion of the rotation shaft 126 may be inserted through the disk 134 of the fixed scroll 130, and the orbiting wrap 144, the fixed wrap 136 and the eccentric bearing 128 may overlap in a lateral direction of the compressor. Upon compression, a repulsive force of a refrigerant may be applied to the fixed wrap 136 and the orbiting wrap 144, while a compression force as a reaction force against the repulsive force may be applied between the rotation shaft coupling portion 146 and the eccentric bearing 128. As such, when a shaft is partially inserted through a disk and overlaps with a wrap, the repulsive force of the refrigerant and the compression force may be applied to the same side surface based on the disk, thereby attenuating each other. Consequently, inclination of the orbiting scroll 140 may be avoided due to the compression force and the repulsive force. Alternatively, an eccentric bushing may be installed instead of the eccentric bearing. In this alternative example, an inner surface of the rotation shaft coupling portion 146, in which the eccentric bushing is inserted, may be specifically processed to serve as a bearing. Other arrangements including installing a separate bearing between the eccentric bushing and the rotation shaft coupling portion may also be considered.

A discharge hole 140*a* may be formed at the disk 142 such that a compressed refrigerant may be discharged into the casing 110. Position and shape of the discharge hole 140*a* may be determined taking into consideration a required discharge pressure and other such factors. The disk 142 may also include a bypass hole 140*b* (see FIG. 8) in addition to the discharge hole 140*a*. When the bypass hole 140*b* is positioned farther away from the center of the disk 142 than the discharge hole 140*a*, the bypass hole 140*b* may have a diameter greater than one third of an effective diameter of the discharge hole 140*a*.

An Oldham ring 150 for preventing rotation of the orbiting scroll 140 may be installed on the orbiting scroll 140. The Oldham ring 150 may include a ring part 152 having an approximately circular shape and inserted on a rear surface of the disk 142 of the orbiting scroll 140, and a pair of first keys 154 and a pair of second keys 156 respectively protruding from a corresponding side surface of the ring part 152. In certain embodiments, the first keys 154 may protrude further than a thickness of an outer circumferential portion of the disk 142 of the orbiting scroll 140 so as to be inserted into first key recesses 154*a* formed in an upper end of the side wall 138 of the fixed scroll 130 and the orbiting scroll support 138*a*. In addition, the second keys 156 may be inserted into second key recesses 156*a* formed at the outer circumferential portion of the disk 142 of the orbiting scroll 140.

Each of the first key recesses 154*a* may have a vertical portion extending upwardly and a horizontal portion extending in a right-and-left, or horizontal, direction. During an orbiting motion of the orbiting scroll 140, a lower end portion of each first key 154 remains inserted in the horizontal portion of the corresponding first key recess 154*a* while an outer end portion of the first key 154 in a radial direction is separated from the vertical portion of the first key recess 154*a*. That is, the first key recesses 154*a* and the fixed scroll 130 are vertically coupled to each other, which may allow for a reduction of a diameter of the fixed scroll 130.

In detail, a clearance (air gap) as wide as an orbiting radius should be provided between the disk 142 of the orbiting scroll 140 and an inner wall of the fixed scroll 130. If an Oldham ring is coupled to a fixed scroll in a radial direction, key recesses formed at the fixed scroll may be longer than at least the orbiting radius in order to prevent the Oldham ring from being separated from the key recesses during orbiting motion. However, this structure may cause an increase in the size of the fixed scroll.

On the other hand, as shown in the exemplary embodiment, if the key recess 156*a* extends down to a lower side of a space between the disk 142 of the orbiting scroll 140 and the orbiting wrap 144, a sufficient length of the key recess 156*a* may be provided without increasing the size of the fixed scroll 130.

In addition, in the exemplary embodiment, all the keys of the Oldham ring 150 may be formed at one side surface of the ring part 152. This structure may reduce the overall vertical height of a compression unit as compared to forming keys at both upper/lower side and surfaces of the ring part 152.

A lower frame 160 for rotatably supporting a lower side of the rotation shaft 126 may be installed at a lower side of the casing 110, and the upper frame 170 for supporting the orbiting scroll 140 and the Oldham ring 150 may be installed on the orbiting scroll 140. A hole 171 may be present at a central portion of the upper frame 170. The hole may communicate with the discharge hole 140*a* of the orbiting scroll 140 to allow a compressed refrigerant to be discharged toward the upper shell 112 therethrough.

The bypass hole 140*b*, as aforementioned, may have a size that is greater than one third of the effective diameter of the discharge hole 140*a*. In one exemplary embodiment, the effective diameter of the discharge hole 140*a* may be approximately 10 mm, and the diameter of the bypass hole 140*b* may be approximately 4.5 mm. Other combinations may also be appropriate. Although not shown, a pair of bypass holes may be provided, and the sum of their areas may correspond to merely 20% of the area of the discharge hole 140*a*. Other combinations may also be appropriate.

As aforementioned, upon formation of the bypass hole, the flow of the refrigerant passing through the bypass hole may become smooth and accordingly the flow velocity of the refrigerant passing through the bypass hole may be reduced. When the bypass hole is small in diameter, on the other hand, the flow velocity of the refrigerant increases and accordingly the refrigerant may not be smoothly discharged through the bypass hole. The flow velocity of the refrigerant passing through the bypass hole may significantly affect reduction of over-compression loss. In particular, the loss value may be remarkably reduced when the flow velocity of the refrigerant passing through the bypass hole is less than 50 m/s.

Figure 11:
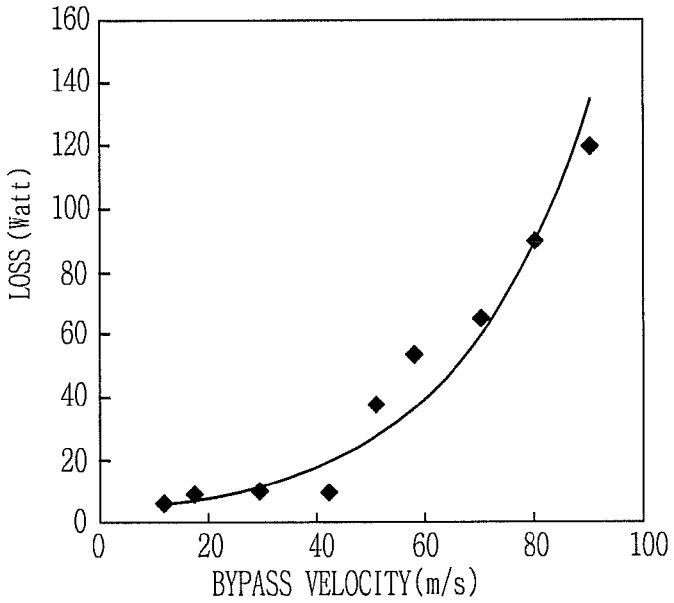
FIG. 11 is a graph showing a relationship between bypass flow velocity and losses due to over-compression.

That is, as shown in FIG. 11, over-compression loss does not increase at a drastic rate up to 50 m/s but it increases significantly when the bypass flow velocity exceeds 50 m/s. Therefore, in order to maintain the bypass flow rate at less than 50 m/s, the diameter of the bypass hole may be increased. However, the diameter of the bypass hole cannot typically be greater than the thickness of the fixed wrap or orbiting wrap that it faces, and the fixed wrap and the orbiting wrap are typically formed as an involute curve.

Figure 4A:
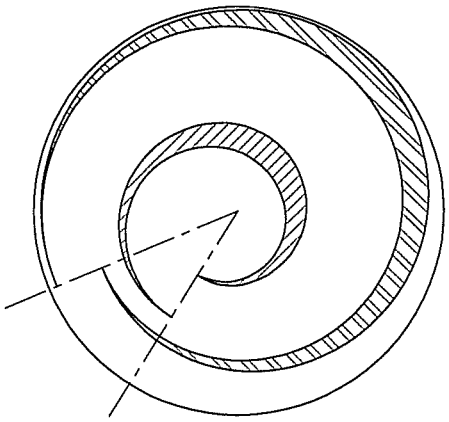
FIGS. 4A and 4B are planar views showing first and second compression chambers right after suction and right before discharge in a scroll compressor having an orbiting wrap and a fixed wrap in an involute shape.
Figure 4B:
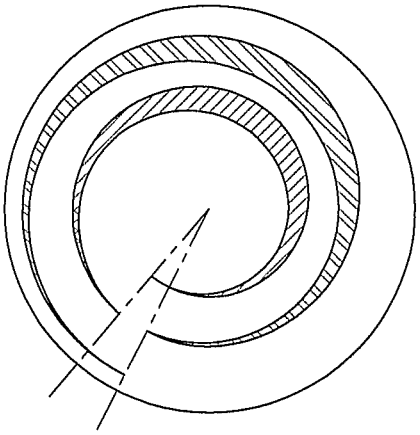

FIGS. 4A and 4B are planar views showing a compression chamber right after a suction operation and a compression chamber right before a discharge operation in a scroll compressor having an orbiting wrap and a fixed wrap formed as an involute curve and having a shaft partially inserted through a disk. FIG. 4A shows the change of a first compression chamber defined between an inner side surface of the fixed wrap and an outer side surface of the orbiting wrap, and FIG. 4B shows the change of a second compression chamber defined between an inner side surface of the orbiting wrap and an outer side surface of the fixed wrap.

In such a scroll compressor, a compression chamber is defined between two contact points generated by contact between the fixed wrap and the orbiting wrap having an involute curve shape. As shown in FIGS. 4A and 4B, two contact points defining one compression chamber are present on a line. In other words, the compression chamber may be present along 360° with respect to the center of the rotation shaft.

Regarding a volume change of the first compression chamber shown in FIG. 4A, the volume of the compression chamber is gradually reduced as it moves toward the central portion in response to the orbiting motion of the orbiting scroll. Thus, when arriving at an outer circumferential portion of a rotation shaft coupling portion located at the center of the orbiting scroll, the first compression chamber has a minimum volume value. For the fixed wrap and the orbiting wrap having the involute curve shape, the volume reduction rate linearly decreases as an orbiting angle (hereinafter, referred to as 'crank angle') of the rotation shaft increases. Hence, to acquire a high compression ratio, the compression chamber may move as close to the center as possible. However, when the rotation shaft is present at the central portion, the compression chamber only may move up to the outer circumferential portion of the rotation shaft. Accordingly, the compression ratio is lowered. A compression ratio of about 2.13 is exhibited in FIG. 4A.

The second compression chamber shown in FIG. 4B has a compression ratio of about 1.46, which is lower than that of the first compression chamber. However, regarding the second compression chamber, if the shape of the orbiting scroll is changed such that a connected portion between a rotation shaft coupling portion P and the orbiting wrap is formed in an arcuate shape, a compression path of the second compression chamber until before a discharge operation may be extended, thereby increasing the compression ratio up to about 3.0. In this case, the second compression chamber extend less than 360° about the center of rotation right before the discharge operation. However, this method may not be applied to the first compression chamber.

Therefore, when the fixed wrap and the orbiting wrap have the involute curve shape, the second compression chamber may have a compression ratio as high as possible but the first compression chamber may not. Also, when the two compression chambers have a significant difference in their compression ratios, it may adversely affect the operation of the compressor and even may lower the overall compression ratio. In addition, in view of the fixed wrap or orbiting wrap having the involute curve shape, such wraps typically have a uniform thickness, so the thickness of the wrap may be increased in order to increase the diameter of the bypass hole, but this may cause an increase in the overall size of the compressor. If the thickness of the wrap is increased while maintaining a given overall size of the compressor, a compression ratio may be decreased. Accordingly, in the scroll compressor having the fixed wrap and the orbiting wrap in the involute curve shape, the diameter of the bypass hole cannot reasonably be increased, so an alternative method of increasing the number of bypass holes may instead be considered.

Figure 12:
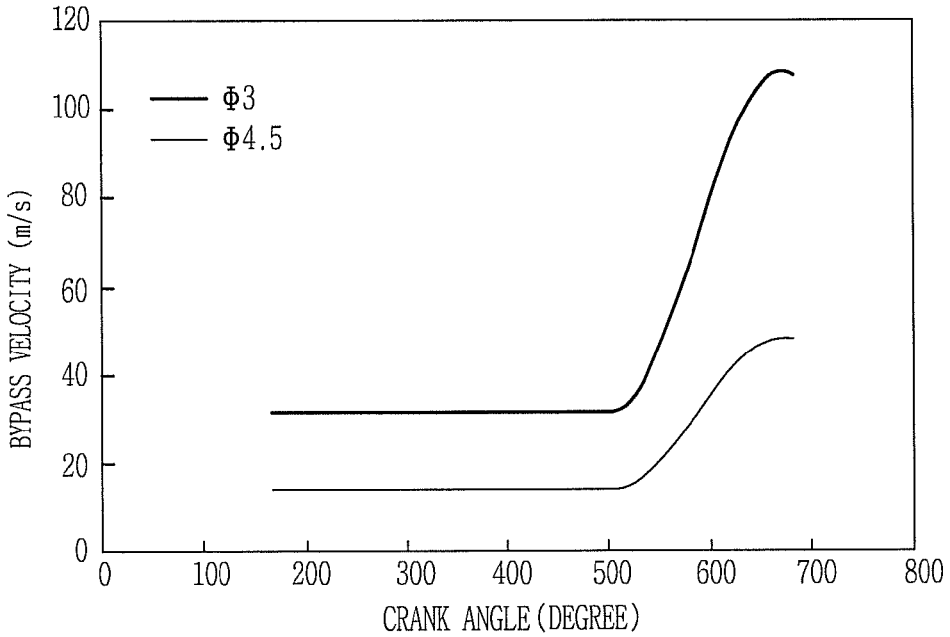
FIG. 12 is a graph showing a relationship between bypass flow velocity and bypass hole diameter.

In detail, as shown in the exemplary embodiment, when the effective diameter of the discharge hole is about 10 mm, a typical scroll compressor may have four bypass holes each having a diameter of 3 mm, thus increasing processing cost of the orbiting scroll or the fixed scroll and decreasing the strength of the disk due to the plurality of holes being formed. FIG. 12 is a graph showing changes in bypass flow velocity when the bypass hole has a diameter of 3 mm and 4.5 mm. As shown in the graph, flow velocity is much faster when the bypass hole has the 3 mm diameter, increasing over-compression loss accordingly.

Accordingly, the exemplary embodiment of a scroll compressor as broadly described herein may include a fixed wrap and an orbiting wrap having a different curve (shape) from the involute curve. FIGS. 6A to 6E show a process of determining shapes of the fixed wrap and the orbiting wrap according to the exemplary embodiment. In FIGS. 6A-6E, a solid line indicates a curve generated for the first compression chamber and a dotted line indicates a curve generated for the second compression chamber.

The generated curve refers to a track drawn by a particular shape during movement. The solid line indicates a track drawn by the first compression chamber during suction and discharge operations, and the dotted line indicates the track of the second compression chamber. Hence, if the generated curve is extended outward from its two opposite sides along long as the orbiting radius of the orbiting scroll based upon the solid line, it exhibits the shapes of an inner side surface of the fixed wrap and an outer side surface of the orbiting wrap. If the generated curve is extended outward to its two opposite sides based upon the dotted line, it exhibits the shapes of an outer side surface of the fixed wrap and an inner side surface of the orbiting wrap.

Figure 5A:
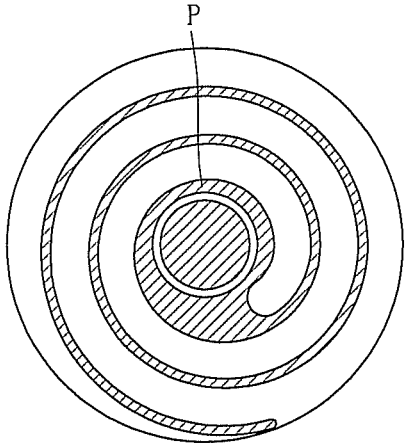
FIGS. 5A and 5B are planar views showing a shape of an orbiting wrap in a scroll compressor having an orbiting wrap and a fixed wrap in another involute shape.
Figure 5B:
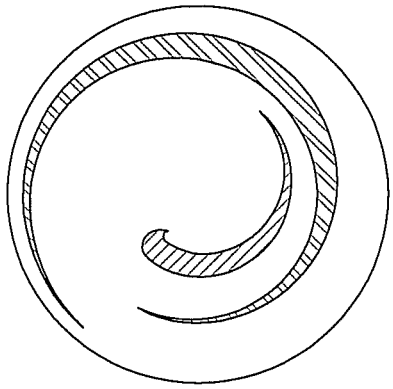
Figure 6A:
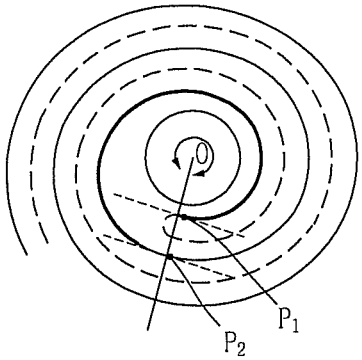
FIGS. 6A-6E illustrate a process for obtaining generating curves in the scroll compressor of the exemplary embodiment shown in FIG. 1.
Figure 6B:
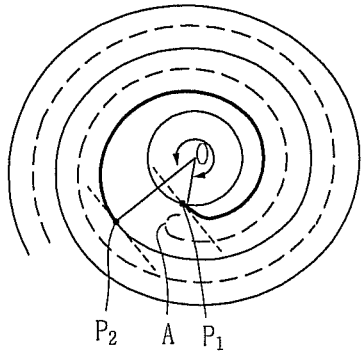

FIG. 6A shows a curve corresponding to having the wrap shape shown in FIG. 5A. Here, a bold line corresponds to the first compression chamber right before a discharge operation. As shown, a start point and an end point are present on a line. In this case, it may be difficult to obtain a sufficient compression ratio. Thus, as shown in FIG. 6B, an end portion of the bold line, located outside, is transferred in a clockwise direction along the curve and an end portion located inside is transferred up to a point so as to contact the rotation shaft coupling portion. That is, a portion of the curve, adjacent to the rotation shaft coupling portion may be curved to have a smaller radius of curvature.

As described above, the compression chamber is defined by two contact points at which the orbiting wrap and the fixed wrap contact each other. The two ends of the bold line in FIG. 6A correspond to the two contact points. Normal vectors at the respective contact points are in parallel to each other according to the operating algorithm of the scroll compressor. Also, the normal vectors are in parallel to a line connecting a center of the rotation shaft and a center of the eccentric bearing. For a fixed wrap and an orbiting wrap having an involute shape, the two normal vectors are parallel to each other and also present on the same line as shown in FIG. 6A.

That is, as shown in FIG. 6A, if it is assumed that the center of the rotation shaft coupling portion 146 is O and two contact points are P1 and P2, then P2 is located on a line connecting O and P1. If it is assumed that a larger angle of the two angles formed by lines OP1 and OP2 is $\alpha$, then $\alpha$ is 360°. In addition, if it is assumed that a distance between the normal vectors at P1 and P2 is l, then l is 0.

However, when P1 and P2 are transferred more internally along the curves, the compression ratio of the first compression chamber may be improved. To this end, when P2 is transferred toward the rotation shaft coupling portion 146, namely, the curve for the first compression chamber is transferred by turning toward the rotation shaft coupling portion 146, P1, which has the normal vector in parallel to the normal vector at P2, then rotates in a clockwise direction based on FIG. 6B, as compared to FIG. 6A, thereby being located at the rotated point. As described above, the first compression chamber is reduced in volume as being transferred more internally along the generating curve. Hence, the first compression chamber shown in FIG. 6B may be transferred more internally as compared to FIG. 6A, and further compressed corresponding amount, thereby obtaining an increased compression ratio.

Figure 6C:
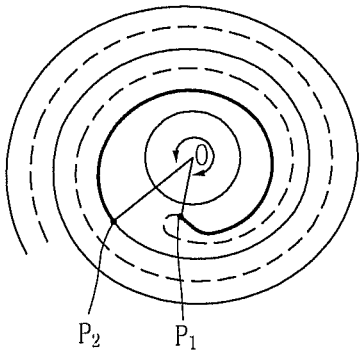
Figure 6D:
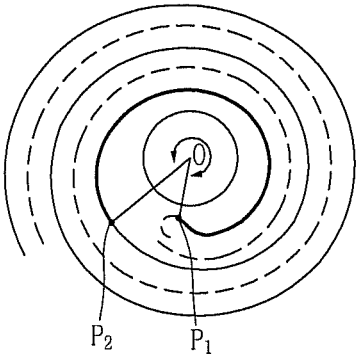

Here, referring to FIG. 6B, the point P1 may be considered to be excessively close to the rotation shaft coupling portion 146. Accordingly, the rotation shaft coupling portion 146 may have to become thinner to accommodate this. Hence, the point P1 is transferred back so as to modify the curve as shown in FIG. 6C. Here, in FIG. 6C, the curves of the first and second compression chambers may be considered to be excessively close to each other, which may correspond to an excessively thin wrap thickness or render it physically too difficult to form the wrap(s). Thus, as shown in FIG. 6D, the curve of the second compression chamber may be modified such that the two generated curves can maintain a predetermined interval therebetween.

Figure 6E:
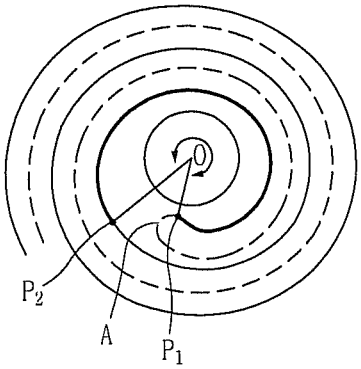

Furthermore, the generated curve of the second compression chamber may be modified, as shown in FIG. 6E, such that an arcuate portion C located at the end of the curve of the second compression chamber may contact the curve of the first compression chamber. The generated curves may be modified to continuously maintain a predetermined interval therebetween. When a radius of the arcuate portion C of the curve of the second compression chamber is increased to ensure wrap rigidity at the end of the fixed wrap, generated curves having the shape shown in FIG. 7 may be acquired.

Figure 7:
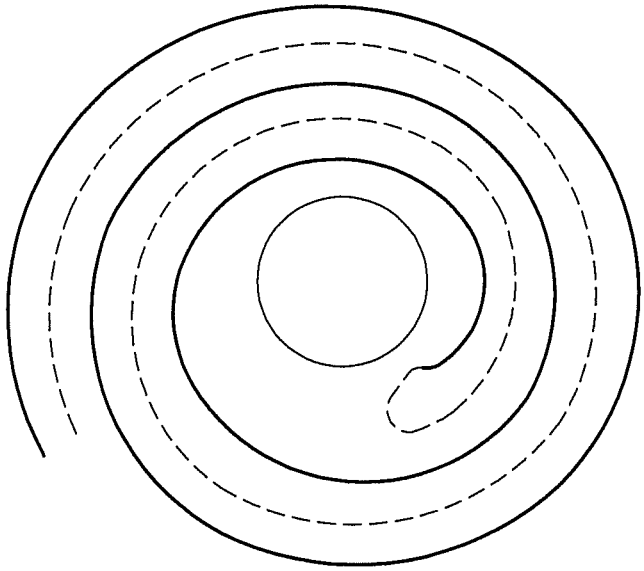
FIG. 7 is a planar view showing final curves generated in accordance with the process shown in FIGS. 6A-6E.
Figure 8:
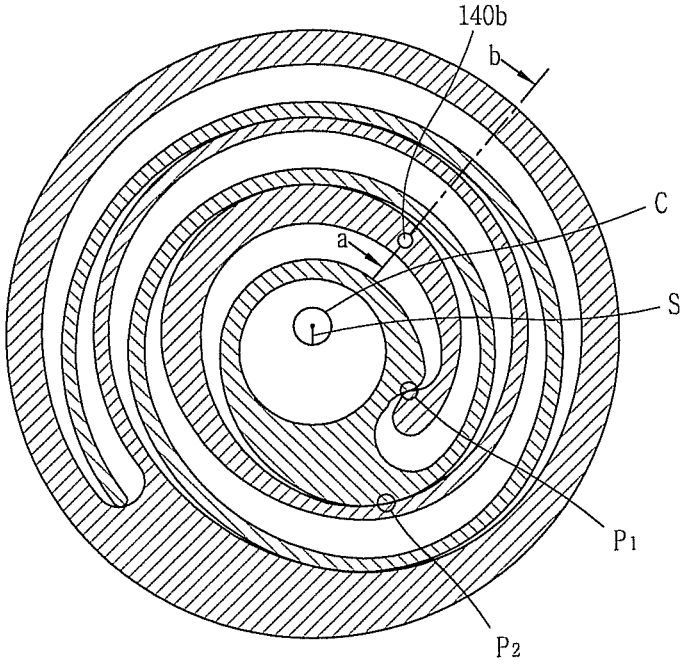
FIG. 8 is a planar view of an orbiting wrap and a fixed wrap formed by the curve shown in FIG. 7.
Figure 9:
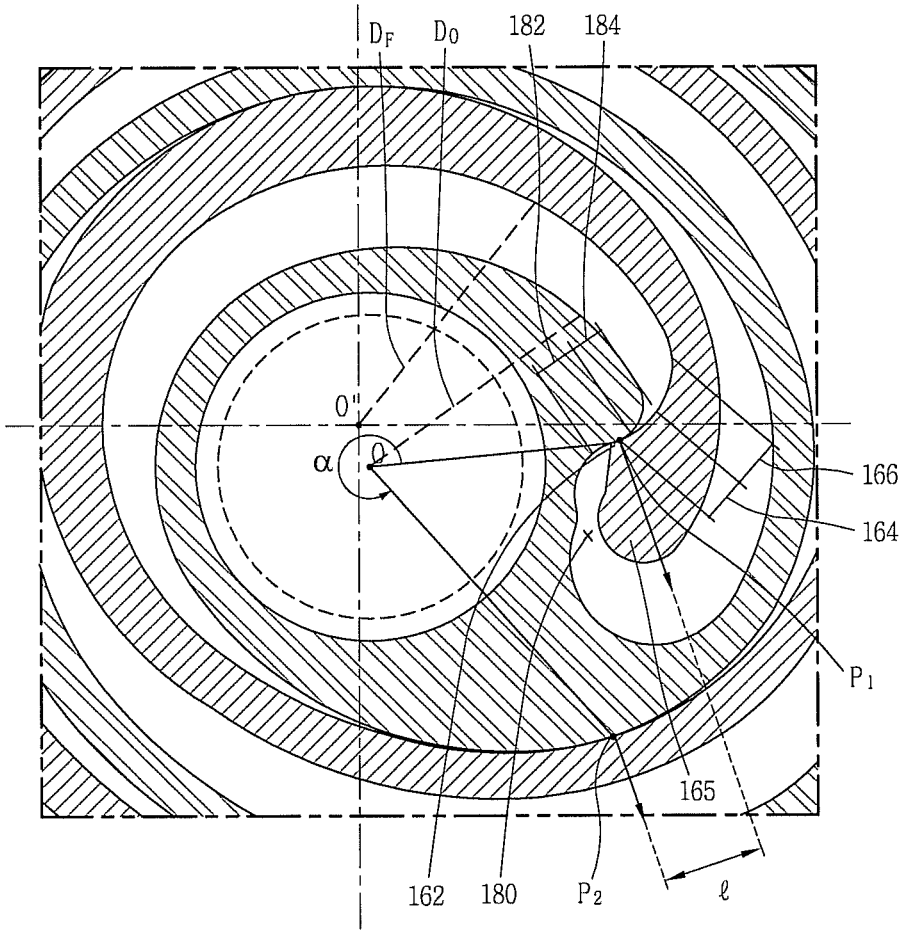
FIG. 9 is an enlarged planar view of a central portion of FIG. 8.

FIG. 8 is a planar view of an orbiting wrap and a fixed wrap obtained based on the generating curves of FIG. 7, and FIG. 9 is an enlarged planar view of the central portion of FIG. 8. For reference, FIG. 8 shows a position of the orbiting wrap at a time point of initiating the discharge operation in the first compression chamber. The point P1 in FIG. 8 indicates a point at an interface of two contact points defining a compression chamber, at the moment when initiating discharging in the first compressor chamber. Such a point is specifically referred to as P3 in FIG. 9. Line S is a virtual line for indicating a position of the rotation shaft and Circle C is a track drawn by the line S. Hereinafter, the crank angle is set to 0° when the line S is present in a state shown in FIG. 8, namely, when initiating discharging, set to a negative (−) value when rotated counterclockwise, and set to a positive (+) value when rotated clockwise.

Referring to FIGS. 8 and 9, an angle $\alpha$ may be defined by two lines which respectively connect the two contact points P1 and P2 to the center O of the rotation shaft coupling portion. The angle $\alpha$ may be less than 360°. A distance l between the normal vectors at each of the contact points P1 and P2 may be greater than 0. Accordingly, the first compression chamber right before a discharge operation may have a smaller volume than that defined by the fixed wrap and the orbiting wrap having the involute shape, which results in an increase in the compression ratio. In addition, the orbiting wrap and the fixed wrap shown in FIG. 8 have a shape including a plurality of connected arcs having different diameters and origins and the outermost curve may have an approximately oval shape with a major axis and a minor axis.

Figure 10:
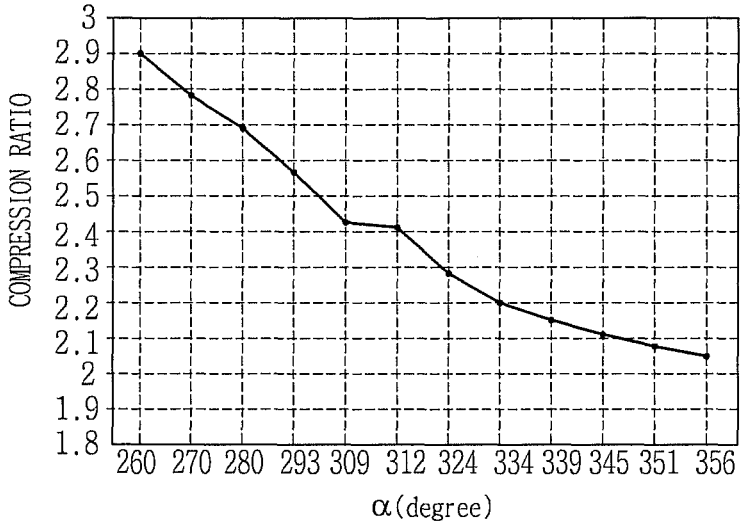
FIG. 10 is a graph showing a relationship between an angle $\alpha$ and a compression ratio.

In the exemplary embodiment, the angle $\alpha$ may have a value in the range of 270 to 345°. FIG. 10 is a graph showing the angle α and a compression ratio. From the perspective of improvement of a compression ratio, the angle α may have a relatively low value. However, if the angle α is smaller than 270°, it may interrupt mechanical processing, thereby adversely affecting productivity and increasing a price of a compressor. If exceeding 345°, the compression ratio may be lowered below 2.1, thereby failing to provide a sufficient compression ratio.

In addition, a protruding portion 165 may protrude from an inner end of the fixed wrap toward the rotation shaft coupling portion 146. A contact portion 162 may protrude from the protruding portion 165 such that the inner end of the fixed wrap 130 may be thicker than other portions. Accordingly, the wrap rigidity of the inner end of the fixed wrap 130, to which the strongest compression force is applied, may be improved, resulting in enhancing durability.

Also, as aforementioned, the thickness of the fixed wrap or the orbiting wrap may be set as necessary to allow the thickness of the orbiting wrap or the fixed wrap where the bypass hole 140*b* is located to be greater than the diameter of the bypass hole 140*b*.

Figure 13:
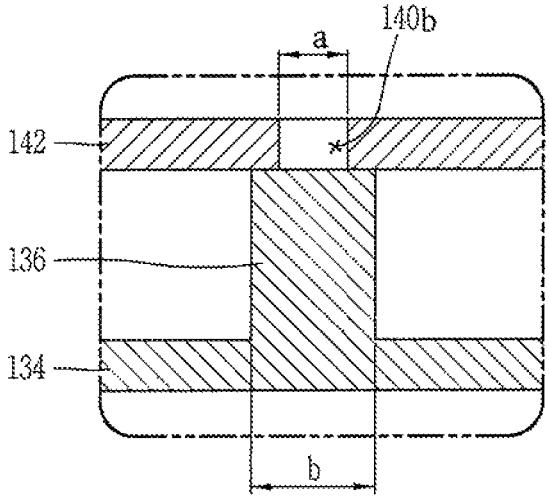
FIG. 13 is a sectional view taken along a line A-A' of FIG. 8.

FIG. 13 is a sectional view showing a portion of the fixed scroll 130 and the orbiting scroll 140 adjacent to the bypass hole 140*b*. As shown in FIG. 13, a diameter a of the bypass hole 140*b* is smaller than a thickness b of the fixed wrap 136. If a>b, two compression chambers located with the fixed wrap 136 interposed therebetween may communicate with each other via the bypass hole, the condition of a<b may be satisfied. A length of a portion c where the disk 142 of the orbiting scroll contacts the fixed wrap 136 may be relatively long to improve a sealing performance between the two compression chambers.

In certain exemplary embodiments, the thickness of the fixed wrap 136 may be set to be 1.5 times greater than an average thickness of the fixed wrap. Other arrangements may also be appropriate.

Figure 17:
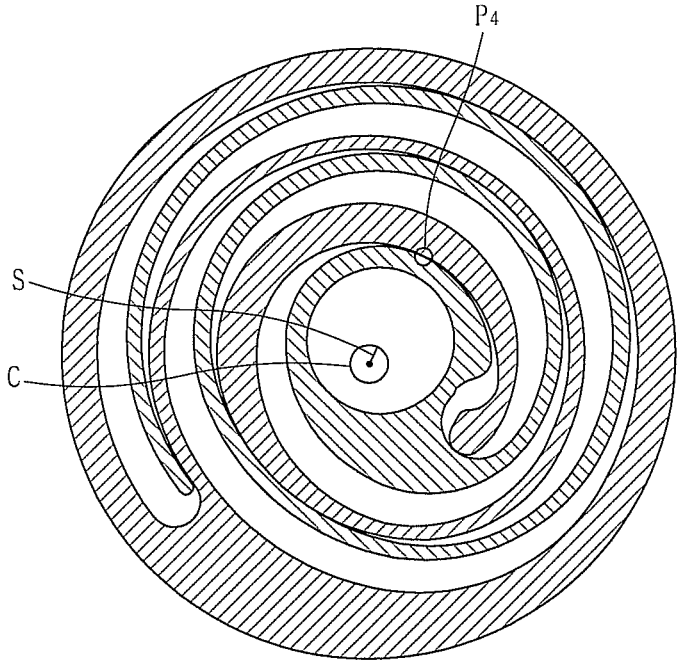
FIG. 17 is a planar view showing a state in which a crank angle is located at 150°.

If it is assumed that a distance between an inner side surface of the fixed wrap and a center O' of the rotation shaft is DF, then DF may be increased and then decreased as it progresses away from P1 in a counterclockwise direction (based on FIG. 9), and such interval is shown in FIG. 17. FIG. 17 is a planar view showing the position of the orbiting wrap 150° before initiating the discharge operation, namely, when the crank angle is 150°. If the rotation shaft rotates 150° more from the state of FIG. 17, it reaches the state shown in FIG. 8. Referring to FIG. 17, an inner contact point P4 of two contact points defining the first compression chamber is located above the rotation shaft coupling portion 146, and the DF is increased and then decreased at the interval from P3 of FIG. 9 to P4 of FIG. 17.

The rotation shaft coupling portion 146 may be provided with a recess portion 180 engaged with the protruding portion 165. One side wall of the recess portion 180 may contact the contact portion 162 of the protruding portion 165 to define one contact point of the first compression chamber. If it is assumed that a distance between the center of the rotation shaft coupling portion 146 and an outer circumferential portion of the rotation shaft coupling portion 146 is Do, then Do may be increased and then decreased at the interval between P3 of FIG. 9 and P4 of FIG. 17. Similarly, the thickness of the rotation shaft coupling portion 146 may also be increased and then decreased at the interval between P3 of FIG. 9 and P4 of FIG. 17.

The one side wall of the recess portion 180 may include a first increase part 182 at which a thickness is relatively significantly increased, and a second increase part 184 extending from the first increase part 182 and having a thickness increased at a relatively low rate. These correspond to the first decrease part 164 and the second decrease part 166 of the fixed wrap. The first increase part 182, the first decrease part 164, the second increase part 184 and the second decrease part 166 may be obtained by turning the generated curve toward the rotation shaft coupling portion 146 at the step of FIG. 6B. Accordingly, the inner contact point P1 defining the first compression chamber may be located at the first and second increase parts, and also the length of the first compression chamber right before the discharge operation may be shortened so as to enhance the compression ratio.

Another side wall of the recess portion 180 may have an arcuate shape. A diameter of the arc may be decided by the wrap thickness of the end of the fixed wrap and the orbiting radius of the orbiting wrap. When the thickness of the end of the fixed wrap increases, the diameter of the arc may increase. Accordingly, the thickness of the orbiting wrap near the arc may increase to provide durability and the compression path may also extend so as to increase the compression ratio of the second compression chamber.

Figure 18:
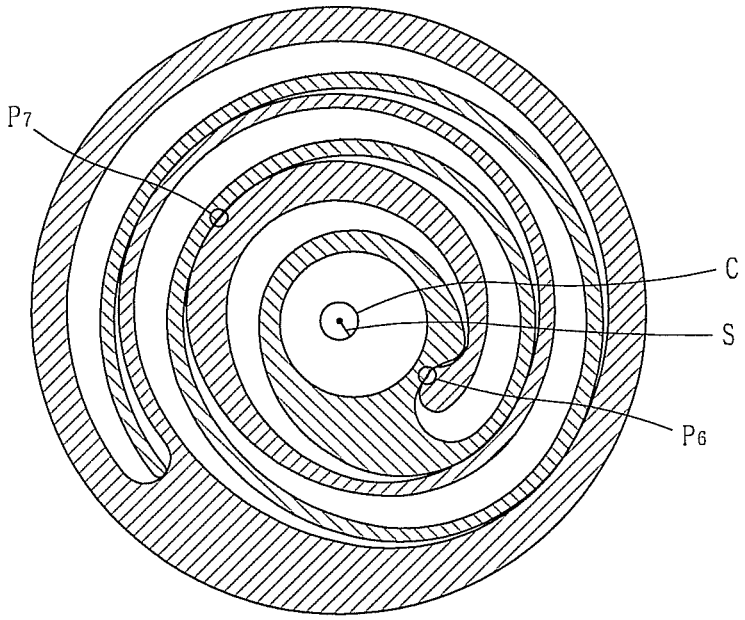
FIG. 18 is a planar view showing initiation of a discharge operation in a second compression chamber in the exemplary embodiment of FIG. 8.

The central portion of the recess portion 180 may form a part of the second compression chamber. FIG. 18 is a planar view showing the position of the orbiting wrap when initiating the discharge operation in the second compression chamber. Referring to FIG. 18, the second compression chamber is defined between two contact points P6 and P7 and contacts an arcuate side wall of the recess portion 180. When the rotation shaft rotates more, one end of the second compression chamber may pass through the center of the recess portion 180.

Figure 14:
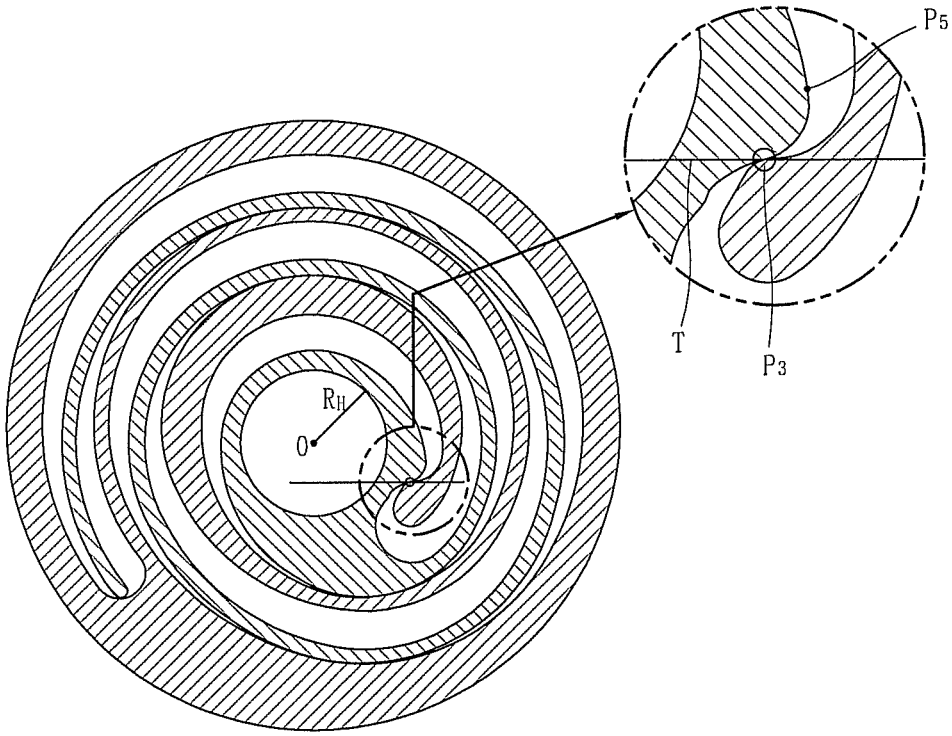
FIG. 14 is another planar view showing an enlarged central portion of FIG. 8.

FIG. 14 is another planar view showing a state shown in FIG. 9. It may be noticed referring to FIG. 14 that a tangent line T drawn at the point P3 passes through the inside of the rotation shaft coupling portion 146. This results from the behavior that the curve is curved inwardly during the process of FIG. 6B. Consequently, a distance between the tangent line T and a center of the rotation shaft coupling portion 146 may be smaller than a diameter RH within the rotation shaft coupling portion 146.

Figure 15A:
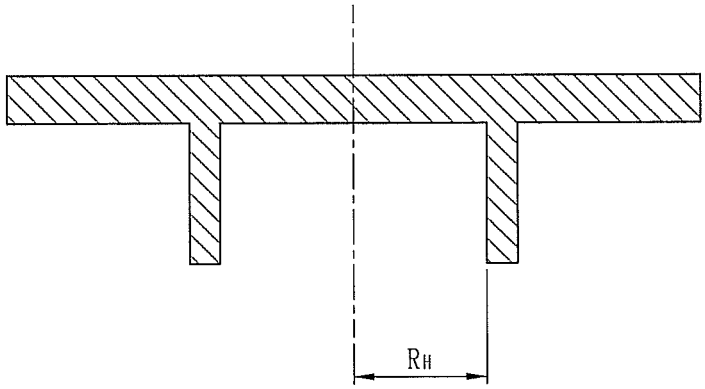
FIGS. 15A and 15B are sectional views of a rotation shaft coupling portion of an orbiting scroll as embodied and broadly described herein.
Figure 15B:
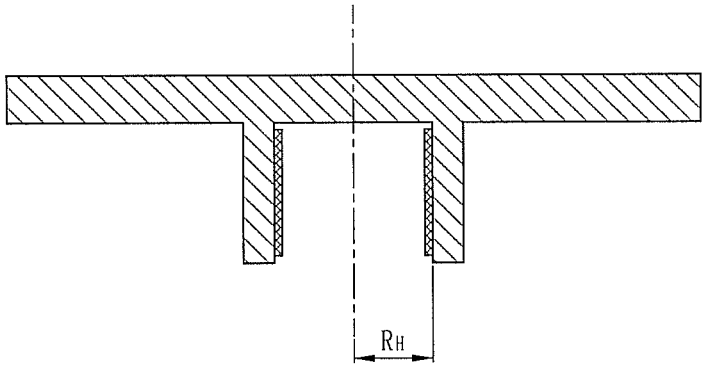

Here, the inner diameter RH may be defined as an inner diameter of the rotation shaft coupling portion 146 when an inner circumferential surface of the rotation shaft coupling portion 146 or an outer circumferential surface of the eccentric bearing 128 is lubricated, as shown in FIG. 15, without a separate bearing, whereas being defined as an outer diameter of the bearing when a separate bearing is additionally employed within the rotation shaft coupling portion as shown in FIG. 15B.

In FIG. 14, a point P5 denotes an inner contact point when the crank angle is 90°, and as shown, a radius of curvature of an outer circumference of the rotation shaft coupling portion may have various values depending on each position between the points P3 and P5. Here, the average radius of curvature Rm defined by the following equation may influence the compression ratio of the first compression chamber.

$$R_m = \frac{1}{90}\int_0^{90} R_\theta d\theta$$

where Rθ is a radius of curvature of the orbiting wrap at the inner contact point of the first compression chamber when the crank angle is θ.

Figure 16:
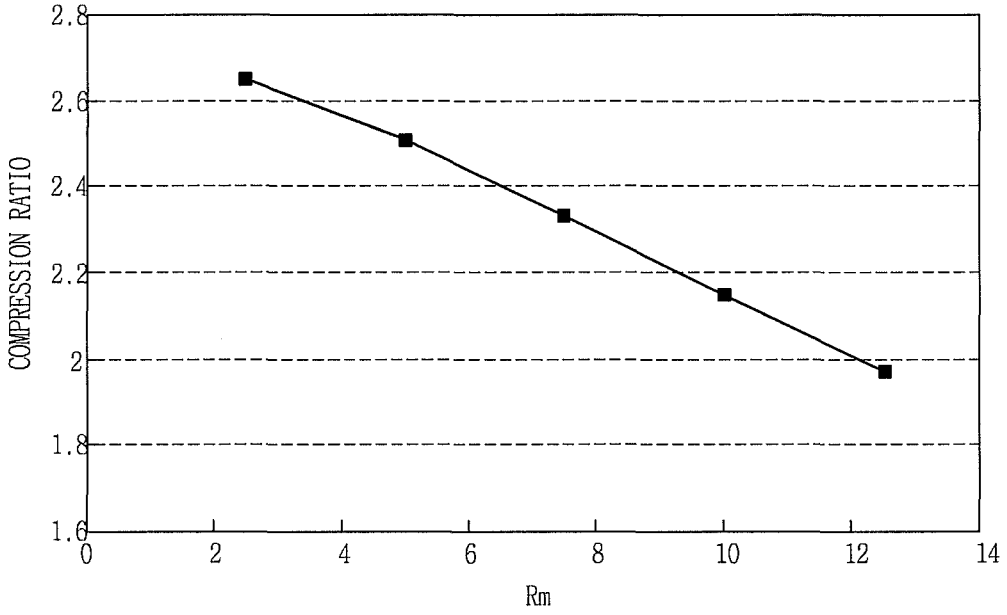
FIG. 16 is a graph showing changes of compression ratios in response to an average radius of curvature.

FIG. 16 is a graph showing a relationship between an average radius of curvature Rm and a compression ratio. In general, a rotary compressor may have a compression ratio more than 2.3 when being used for both cooling and heating, and more than 2.1 when being used for cooling. Referring to FIGS. 15 and 16, when the average radius of curvature Rm is less than 10.5, the compression ratio may be more than 2.1. Therefore, if Rm is set to be less than 10.5 mm, the compression ratio may be more than 2.1. Here, the Rm may be optionally set to be suitable for the use of the scroll compressor. In the exemplary embodiment, the RH may have a value of approximately 15 mm. Therefore, the Rm may be set to be smaller than RH/1.4.

Meanwhile, the point P5 may not always be limited when the crank angle is 90°. In view of the operating algorithm of the scroll compressor, a design variable with respect to a radius of curvature after 90° may be relatively low. Accordingly, in order to improve a compression ratio, it may be advantageous to change a shape between 0° and 90°, in which the design variable is relatively high.

A scroll compressor is provided in which overall height may be reduced.

A scroll compressor is provided in which a number of bypass holes may be decreased by increasing a diameter of the bypass hole.

A scroll compressor as embodied and broadly described herein may include a fixed scroll having a fixed wrap having a thickness changing along a compression path, an orbiting scroll having an orbiting wrap defining a compression chamber together with the fixed wrap and having a thickness changing along the compression path, a rotation shaft having an eccentric portion at one end thereof, the rotation shaft coupled to the orbiting scroll such that the eccentric portion overlaps the orbiting wrap in a lateral direction; and a driving unit to drive the rotation shaft, wherein a discharge hole and at least one bypass hole are formed on the orbiting scroll which are communicated to a discharging space of the scroll compressor.

In such a scroll compressor, since the fixed scroll may act as a main frame, the thickness of the upper frame may be reduced.

In certain embodiments, the fixed wrap or the orbiting wrap may be allowed to have an irregularly increasing or decreasing thickness other than a uniform thickness, so as to increase the diameter of the bypass hole as long as desired. Also, the diameter of the bypass hole may be greater than one third of an effective diameter of the discharge hole, to allow the refrigerant to be discharged fast and smoothly through the bypass hole, resulting in reduction of an over-compression loss and prevention of damage on the fixed wrap or orbiting wrap due to excessive pressure.

The effective diameter may correspond a diameter of a circle having the same area as the area of the discharge hole. However, the discharge hole may be formed in a random shape in addition to the circular shape.

The bypass hole may be open or closed by a part of the fixed wrap of the fixed scroll during the orbiting motion of the orbiting scroll. Here, a thickness of a portion of the fixed wrap facing the bypass hole may be formed greater than the diameter of the bypass hole. If the thickness of the corresponding portion of the fixed wrap is smaller than the diameter of the bypass hole, two compression chambers disposed with the fixed wrap interposed therebetween may communicate with each other, thereby causing a loss.

In certain embodiments, the thickness of the fixed wrap may be 1.5 times greater than an average thickness of the fixed wrap. Even when the thickness of the fixed wrap is greater than the diameter of the bypass hole, a leakage may be generated between a disk of the orbiting scroll and an upper surface of the fixed wrap. Hence, the fixed wrap may be thick in thickness, if possible, for prevention of such leakage.

The diameter of the bypass hole may be set such that a flow velocity of a refrigerant passing through the bypass hole can be less than 50 m/s.

In accordance with another embodiment as broadly described herein, the number of bypass holes may be reduced by increasing a diameter of the bypass hole, which allows for reduction of the processing cost of the fixed scroll or orbiting scroll and smooth discharging of the refrigerant through the bypass hole, resulting in reduction of an over-compression loss and prevention of damage on the fixed wrap or orbiting wrap in advance.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing;

a fixed scroll fixed in the casing, the fixed scroll including a fixed wrap having a thickness that varies along a compression path;

an orbiting scroll having an orbiting wrap engaged with the fixed wrap so as to define at least one compression chamber together with the fixed wrap, the orbiting wrap having a thickness that varies along the compression path;

a shaft having an eccentric portion coupled to the orbiting scroll such that the eccentric portion overlaps the orbiting wrap in a lateral direction of the compressor;

a driver that rotates the shaft;

a discharge hole and at least one bypass hole each formed in the orbiting scroll, in communication with a discharging space of the compressor; and an upper frame provided in the casing, wherein the upper frame divides an inner space of the casing into the discharging space and a suctioning space, wherein the upper frame comprises a discharge passage that provides communication between the discharge hole formed in the orbiting scroll and the discharging space formed above the upper frame, and wherein the discharge passage formed in the upper frame also provides communication between the at least one bypass hole formed in the orbiting scroll and the discharging space formed above the upper frame.

2. The compressor of claim 1, wherein the thickness of the fixed wrap at a portion that faces the at least one bypass hole during the orbiting is greater than a diameter of the at least one bypass hole.

3. The compressor of claim 2, wherein the thickness of the fixed wrap at the portion is 1.5 times greater than an average thickness of the fixed wrap.

4. The compressor of claim 1, wherein a diameter of the at least one bypass hole corresponds to a flow velocity of a refrigerant passing therethrough of less than 50 m/s.

5. The compressor of claim 1, wherein the at least one bypass hole comprises a plurality of bypass holes, and wherein a diameter of each of the plurality of bypass holes is greater than one third of an effective diameter of the discharge hole.

6. The compressor of claim 5, wherein the effective diameter of the discharge hole is 10 mm, and wherein the diameter of each of the plurality of bypass holes is 4.5 mm.

7. The compressor of claim 1, wherein a total area of the at least one bypass hole is greater than 20% of an area of the discharge hole.

8. The compressor of claim 1, further comprising at least one bypass valve respectively coupled to the at least one bypass hole.

9. The compressor of claim 8, wherein the at least one bypass valve is configured to open the at least one bypass hole when a pressure in the at least one bypass hole exceeds a predetermined value.

10. The compressor of claim 1, wherein the orbiting scroll is positioned above the fixed scroll, and the upper frame is positioned above the orbiting scroll, and wherein the discharging space is formed above the upper frame and the suctioning space is formed beneath the orbiting scroll.

11. The compressor of claim 10, wherein the orbiting scroll comprises:

an orbiting disk, wherein the orbiting wrap extends downward from the orbiting disk toward the fixed scroll; and a shaft coupling portion formed at a central portion of the orbiting wrap, wherein the eccentric portion of the shaft is received in the shaft coupling portion.

12. The compressor of claim 11, wherein the fixed scroll further comprises:

a fixed disk, wherein the fixed wrap extends upward from the fixed disk toward the orbiting scroll; and a boss that extends downward from a central portion of the fixed disk, wherein the shaft extends through the boss and into the shaft coupling portion of the orbiting scroll.

13. A compressor, comprising:

a casing;

a fixed scroll fixed in the casing, the fixed scroll having a fixed wrap;

an orbiting scroll having an orbiting wrap engaged with the fixed wrap so as to define at least one compression chamber together with the fixed wrap;

a shaft having an eccentric portion coupled to the orbiting scroll such that the eccentric portion overlaps the orbiting wrap in a lateral direction of the compressor;

a driver that rotates the shaft;

a discharge hole and at least one bypass hole each formed in the orbiting scroll, in communication with a discharging space of the compressor; and a frame provided in the casing, wherein the frame divides an inner space of the casing into the discharging space and a suctioning space, wherein the frame comprises a discharge passage that provides communication between the discharge hole and the discharging space, and wherein the discharge passage formed in the frame also provides communication between the at least one bypass hole and the discharging space.

14. The compressor of claim 13, wherein the fixed wrap has a thickness that varies along a compression path, and wherein the orbiting wrap has a thickness that varies along the compression path.

15. The compressor of claim 14, wherein the thickness of the fixed wrap at a portion that faces the at least one bypass hole during the orbiting is greater than a diameter of the at least one bypass hole.

16. The compressor of claim 13, further comprising at least one bypass valve respectively coupled to the at least one bypass hole.

17. The compressor of claim 16, wherein the at least one bypass valve is configured to open the at least one bypass hole when a pressure in the at least one bypass hole exceeds a predetermined value.

18. The compressor of claim 13, wherein the orbiting scroll is positioned above the fixed scroll, and the frame is positioned above the orbiting scroll, and wherein the discharging space is formed above the frame and the suctioning space is formed beneath the orbiting scroll.

19. The compressor of claim 18, wherein the orbiting scroll comprises:

an orbiting disk, wherein the orbiting wrap extends downward from the orbiting disk toward the fixed scroll; and a shaft coupling portion formed at a central portion of the orbiting wrap, wherein the eccentric portion of the shaft is received in the shaft coupling portion.

20. The compressor of claim 19, wherein the fixed scroll comprises:

a fixed disk, wherein the fixed wrap extends upward from the fixed disk toward the orbiting scroll; and a boss that extends downward from a central portion of the fixed disk, wherein the shaft extends through the boss and into the shaft coupling portion of the orbiting scroll.

* * * * *